US006156248A

United States Patent [19]

Walling

[11] Patent Number: 6,156,248

[45] Date of Patent: Dec. 5, 2000

[54] METHOD FOR PUTTY APPLICATION

[76] Inventor: Larry H. Walling, 333 Vista de la Cumbre, Santa Barbara, Calif. 93105-2814

[21] Appl. No.: 08/309,577

[22] Filed: Sep. 21, 1994

[51] Int. Cl.[7] ..... B32B 35/00

[52] U.S. Cl. ..... 264/36.2; 156/94; 264/36.22; 425/12

[58] Field of Search ..... 264/35, 36, 36.2, 264/36.22; 425/11–13; 156/94; 427/427

[56] References Cited

U.S. PATENT DOCUMENTS

| | | | |
|---|---|---|---|
| 3,858,839 | 1/1975 | Bowman | 264/36 X |
| 4,351,508 | 9/1982 | Hardman | 264/36 X |
| 4,360,994 | 11/1982 | Hodges | 264/36 X |
| 4,707,391 | 11/1987 | Hoffmann, Sr. | 156/94 X |
| 4,753,695 | 6/1988 | Alexander et al. | 264/36 X |
| 4,877,648 | 10/1989 | Sotelo | 264/36 X |
| 5,063,006 | 11/1991 | Tahara | 264/36 X |
| 5,227,112 | 7/1993 | Schimpff | 264/36 X |
| 5,240,224 | 8/1993 | Adams | 264/35 X |
| 5,320,790 | 6/1994 | Lowe | 264/35 X |
| 5,401,152 | 3/1995 | Jacino et al. | 264/36 X |

FOREIGN PATENT DOCUMENTS

| | | | |
|---|---|---|---|
| 3620490 | 12/1987 | Germany | 264/36 |
| 821535 | 10/1959 | United Kingdom | 264/36 |

*Primary Examiner*—Karen Aftergut

[57] ABSTRACT

A method and apparatus for applying putty and filler material to fill a hole in a surface. The apparatus includes a transparent and flexible plastic template that is impervious to the solvents and chemicals used in construction and painting. The template has an aperture allowing for the insertion of filler material into a hole in a surface without allowing the filler material to come into contact with the surface itself.

2 Claims, 2 Drawing Sheets

METHOD FOR PUTTY APPLICATION

BACKGROUND OF THE INVENTION

1. Field of the Invention

The present invention relates to the field of use of construction. More particularly, the present invention relates to a method and apparatus for applying putty and filler.

2. Description of Related Art

In the final stages of construction, remodeling or repair, great care is often needed in ensuring that the final finish of surfaces, particularly wood surfaces, is uniform. Many times, holes caused by impurities in the material or fasteners (e.g. nails and screws) need to be filled before any painting or staining can be initiated.

In filling these holes, substances such as wood filler, "Spackle," or putty are often used. These substances can be painted or stained to match the surrounding materials. However, problems can arise when the putty is applied incorrectly. It is very common to encounter partially filled holes where not enough filler material was used (also known as "half moons"), unintentional depressions in the filler where too much pressure was used in pressing the filler material into the hole (also known as "dips"), or residual putty material above or around the hole (also known as "clouds").

Although these imperfections can be corrected or removed (e.g. half moons and dips can be filled and clouds can be sanded), doing so is often time consuming and, thus, inefficient. Moreover, when the hole to be filled appears on textured materials such as open-grained woods, sandblasted woods, re-sawn woods, etc., it is often difficult, if not impossible, to remove the imperfections without damaging the surrounding texture or leaving a "halo" (i.e. a ring of putty) around the hole.

SUMMARY

In painting and construction, it is desirable to have finished surfaces that are homogenous and unblemished. Thus, any holes that might result from the insertion of fasteners or defects in the material need to be completely filled without leaving residues or excess filler. Further, it is desirable that the operation of filling the holes be simple and not time consuming.

It is an object of the present invention to provide a tool and method for applying putty and filler which does not leave any imperfections or residual filler material around the hole. It is another object of the present invention to offer a tool and method for applying putty and filler that requires only light sanding. It is a further object of the present invention to provide a tool and method for applying putty and filler which is simple to use and decreases the time needed to train unskilled workers in the process of filling holes. Lastly, it is an object of the present invention to provide a tool and method for applying putty and filler which is inexpensive to manufacture and is impervious to the various solvents and chemicals used in construction and painting.

The current invention consists of a transparent and flexible plastic template that is impervious to the solvents and chemicals used in construction and painting. The template has an aperture which is placed over a hole in a surface and allows for the insertion of filler material into the hole without allowing the filler material to come into contact with the surface. The excess filler material is then removed by the use of the user's thumb. Lastly, the putty application tool would be removed, either by sliding the tool along the surface or lifting the tool vertically off the surface.

Different templates, each having an aperture of differing diameters, may be used to match holes of varying sizes. An alternate embodiment of the present invention has multiple apertures on a single template, thereby allowing the filling of many different sized holes by the use of only one template.

BRIEF DESCRIPTION OF THE DRAWINGS

The present invention will be described with respect to the following figures in which.

DETAILED DESCRIPTION OF THE INVENTION

The present invention detailed below provides a tool for applying putty and filler. In the following description, numerous specific details are set forth such as template shapes, aperture shapes and materials in order to provide a thorough understanding of the present invention. It will be obvious, however, to one skilled in the art that the present invention may be practiced without the specific details.

Figure 1:
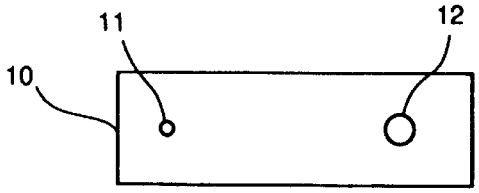
FIG. 1 illustrates a top view of a putty application tool.

FIG. 1 shows a first view of the preferred embodiment of the present invention, which is a top view of a putty application tool 10 for applying filler and putty to seal holes. The putty application tool 10 is of a rectangular shape, approximately 1.125 inches wide and 2.5 inches long, with a thickness of 6 to 8 mils. As to be fully discussed below, the putty application tool can also be of a different thickness, depending on the type of filler material to be used in filling the hole.

The putty application tool 10 is comprised of a transparent material, such as plastic, that is impervious to the solvents and thinner normally used in construction. The putty application tool 10 has a putty aperture 12 placed at 0.125 inches from the shorter edge of the putty application tool. If desired, the putty application tool 10 may also have a key chain aperture 11 placed at 0.125 inches from the other shorter edge of the putty application tool. Both the putty aperture 12 and the key chain aperture 11 are centered with respect to the width of the putty application tool.

The preferred method of using the putty application tool 10 will now be described with references to FIGS. 2*a* through 2*e*.

Figure 2A:
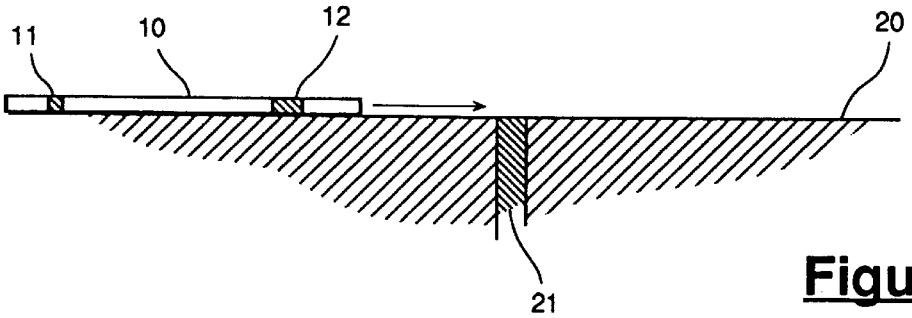
FIG. 2*a* illustrates a cross-sectional view of the putty application tool being slid over a hole in a surface that has to be filled.

FIG. 2*a* shows the putty application tool 10 being placed on a surface 20 having a hole 21, before being slid over the hole 21.

Figure 2B:
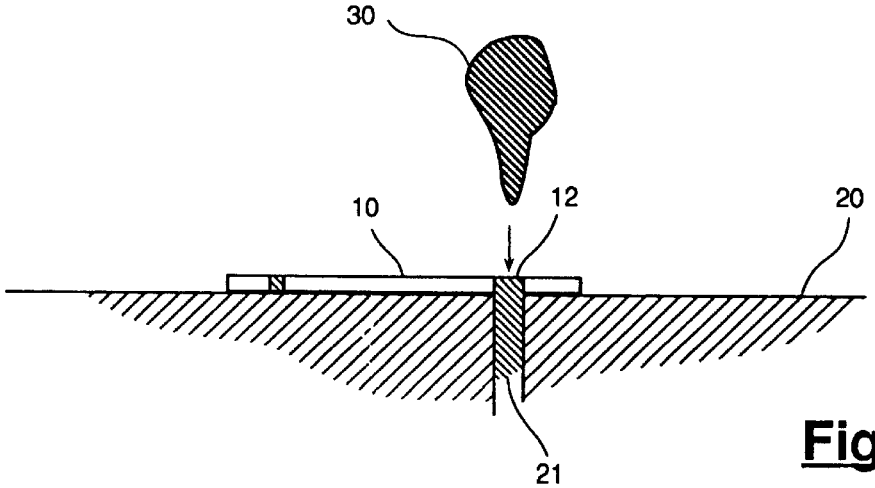
FIG. 2*b* illustrates a cross-sectional view of the filling material being inserted into the hole to be filled through an aperture of the putty application tool.

FIG. 2*b* shows the putty application tool 10 after it has been slid over a hole 21 in surface 20 such that the putty aperture 12 is positioned directly over hole 21. The putty application tool 10 has been chosen so that the putty aperture 12 is the same diameter as the hole 21. Filling material 30 will be placed in the hole 21 passing through the putty aperture 12 of the putty application tool 10.

Figure 2C:
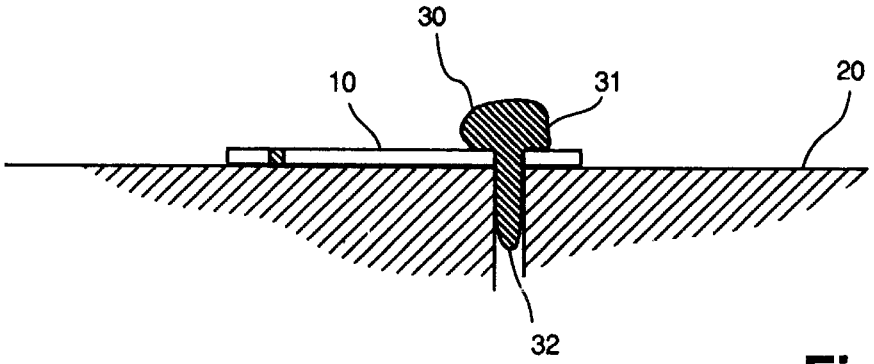
FIG. 2*c* illustrates a cross-sectional view where the filling material has been inserted into the hole to be filled through the aperture of the putty application tool with excess filling material disposed on the surface of the tool.

FIG. 2*c* shows the filling material 30 having been inserted into the hole 21 by passing through the putty aperture 12 of the putty application tool 10. A portion of the filling material 30 which is not being used to fill the hole 21 remains disposed on the surface of the putty application tool 10 as excess filling material 31. Thus, hole 21 has been substantially filled by an inserted filling material 32.

Figure 2D:
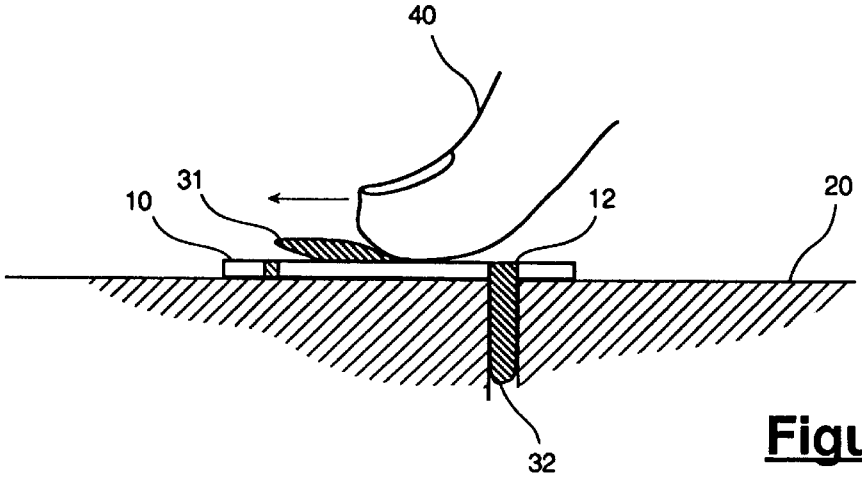
FIG. 2*d* illustrates a cross-sectional view where the excess filling material disposed on the surface of the putty application tool is being removed.

FIG. 2*d* shows the excess filling material 31 being removed by a thumb 40 of a user by the user sliding the thumb 40 on the surface of the putty application tool 10, leaving inserted filling material 32 in the surface 20 and extending into the aperture 12.

Figure 2E:
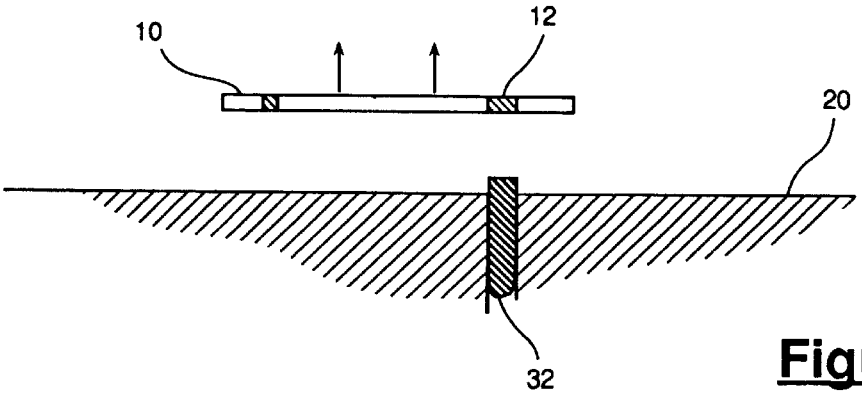
FIG. 2*e* illustrates a cross-sectional view where the putty application tool is being removed.

FIG. 2*e* shows the putty application tool being lifted off of the surface 20 and leaving filling material 32 in the surface 20. The filling material 32 will become flush with the surface 20 when the filling material 32 dries and shrinks. The thickness of the putty application tool has been chosen to ensure that a proper amount of filling material 32 would be above the surface 20.

As noted above, depending on the type of filler material used and the size of the hole to be filled, the putty application tool can be of different thicknesses to account for shrinkage when the filler material dries. Moreover, if a non-shrinking filler material is being used, the putty application tool can be slid along the surface to cut off the excess filling material so that there is no filling material protruding from the surface.

Figure 3:
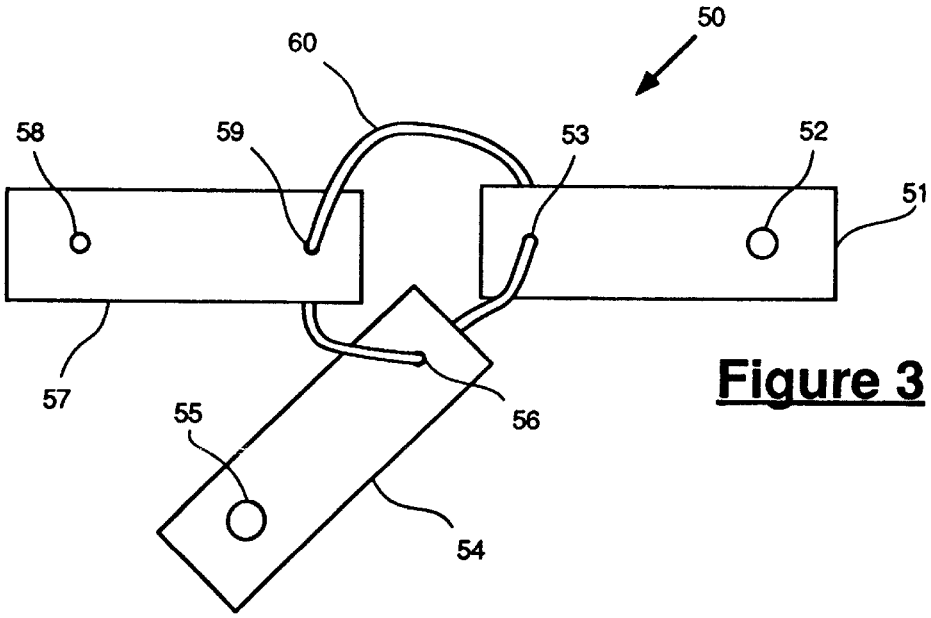
FIG. 3 illustrates a top view of a set of putty application tools.

FIG. 3 shows a set of putty application tools 50, where each putty application tool 51, 54 and 57 has a putty aperture 52, 55 and 58, respectively. Putty apertures 52, 55 and 58 are of different diameters to ensure a close fit in size between the putty aperture of the chosen putty application tool and the hole to be filled. For example, the diameter of the putty apertures may range from a size as small as one sixteenth of an inch to one that is several times this size. Moreover, the putty aperture of the putty application tool may be of any shape, such as a circle, rectangle or triangle, to match the shape of the hole. The putty application tools 51, 54 and 57 may be transported together using a string or chain 60 that is strung through key chain apertures 53, 56 and 59 of putty application tools 51, 54 and 57, respectively. Alternatively, a putty application tool having multiple putty apertures that differ in size or shape may be provided.

Although the present invention has been described in terms of particular embodiments, it will be appreciated that various modifications and alterations might be made by those skilled in the art without departing from the spirit and scope of the present invention. The invention should, therefore, be measured in terms of the claims which follow.

What is claimed is:

1. A method for applying a filler material to fill a hole with a size and a shape in a surface, comprising the steps of:

providing a putty application tool with an aperture, said aperture being approximately equal to said size and said shape of said hole;

placing said putty application tool on said surface such that said putty application tool is slidable thereon;

positioning said putty application tool such that said aperture is substantially aligned over said hole;

inserting said filler material into said hole through said aperture of said putty application tool;

removing excess filler material disposed on said putty application tool; and removing said putty application tool from said surface before said filler material dries.

2. The method of claim 1, wherein said step of providing further comprises the step of:

selecting one of a plurality of putty application tools of differing thicknesses, said selected one putty application tool having a thickness such that a quantity of said filler material is left disposed above said surface, after said excess filler material is removed, to become substantially flush with said surface after said filler material dries.

* * * * *